United States Patent [19]

Nagel

[11] 4,342,937

[45] Aug. 3, 1982

[54] METAL HALOGEN VAPOR LAMP PROVIDED WITH A HEAT REFLECTING LAYER

[75] Inventor: Ferenc Nagél, Budapest, Hungary

[73] Assignee: Egyesült Izzólámpa és Villamossági Rt., Budapest, Hungary

[21] Appl. No.: 120,915

[22] Filed: Feb. 12, 1980

[51] Int. Cl.[3] ..... H01J 5/16

[52] U.S. Cl. ..... 313/113; 313/47

[58] Field of Search ..... 313/44, 47, 113; 220/2.1 R, 3.1

[56] References Cited

U.S. PATENT DOCUMENTS

| | | | |
|---|---|---|---|
| 3,374,377 | 3/1968 | Cook | 313/47 X |
| 3,842,304 | 10/1974 | Beyer et al. | 313/47 X |
| 3,851,200 | 11/1974 | Thomasson | 313/113 |

*Primary Examiner*—Davis L. Willis

*Attorney, Agent, or Firm*—Gabriel P. Katona

[57] ABSTRACT

The invention relates to a metal halogen vapor lamp with a discharge tube coated on surfaces adjacent to its electrodes with a heat reflecting layer. The discharge space comprising a discharge tube is made of a material which is permeable to light, preferrably quartz. The discharge space is between electrodes having a high melting point. An arc discharge takes place in the discharge space between the electrodes.

The discharge space contains a metal of high vapor pressure at operational temperatures, a noble gas and, as additives, at least one metal and a halogen which forms a halogen compound with said metal.

There is a heat reflecting layer with advantageous properties at one or both ends of the discharge tube of a material of high melting point, preferably quartz. The characteristics of said layer differ in many respects from the properties of previously known heat reflecting layers since it is bound to the surface of the quartz discharge tube by an inorganic binding material.

The heat reflecting layer prepared in accordance with our invention comprises as heat reflecting materials, zirconium oxide, cobalt aluminate, quartz wool or combinations thereof which are fixed or bound onto the discharge tube by means of magnesium oxychloride, known as Sorel-Cement. The binder remains on the discharge tube even after the tube is burnt.

5 Claims, 1 Drawing Figure

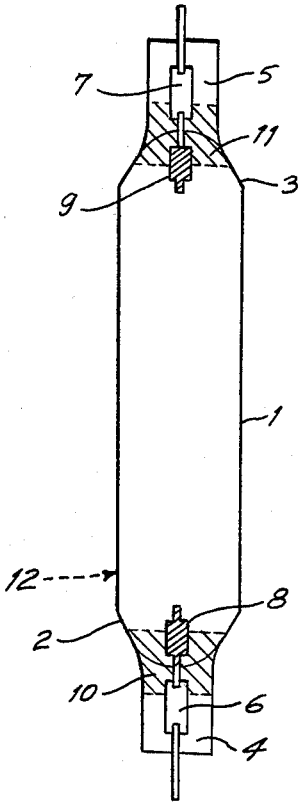
7
5
11
3
9
1
12
8
2
10
6
4

METAL HALOGEN VAPOR LAMP PROVIDED WITH A HEAT REFLECTING LAYER

BACKGROUND OF THE INVENTION

The invention relates to a metal halogen vapour lamp provided with a heat reflecting layer, a discharge tube made of a light permeable material with a high melting point, preferably quartz; wherein an arc discharge takes place in the discharge tube between high melting point electrodes therein. The discharge tube contains a metal of high vapor pressure at operational temperature, a noble gas and, as additives, at least one metal and a halogen which forms a halogen compound with a said metal.

At each end of the discharge tube of the lamp according to the invention, which tube is a material of high melting point, preferably quartz, there is a heat reflecting layer which is different from and has advantageous properties over know heat reflecting layers.

U.S. Pat. No. 3,234,421 discloses metal halogen vapour lamps widely used in the industry and for outdoor illumination. The appearance of said lamps is similar to the traditional, high pressure mercury vapour lamps provided with a quartz discharge tube. The discharge tubes of these commercially available lamps contain, in certain cases, beside mercury sodium iodide, thallium iodide and indium iodide, and in other cases they contain iodiodes of rare earth metals, cesium iodide and thallium iodide, however, several other versions are available.

During normal operation, the two ends of the discharge tube of the known lamps are the coldest points thereof. If necessary precautions are not carried out to increase the temperature of the ends of the discharge tube, certain metal halide compounds quickly condense at each end of the discharge tube behind the electrodes. This decreases the efficiency of the lamp and renders the lamps unserviceable, because some metal halogen compounds having an important role in discharge get separated from the discharge gas mixture. In order to prevent separation, generally heat and light reflecting layers are applied onto the ends of the discharge tube with the purpose to increase the temperature at the ends of the discharge tube.

One version of the so-called heat reflecting coating widely used for said purpose is described in U.S. Pat. No. 3,374,377. According to the disclosure of said patent, the heat reflecting layer consists essentially of $ZrO_2$. The $ZrO_2$ coating displays proper heat insulating features, since it neither blackens nor emits detrimental gases into the space between the discharge tube and the outer bulb. However, no satisfactory means of applying the heat reflecting layer was developed. The methods used result in a brittle coating which tends to peel off, does not stick well and, due to the impacts occuring during transport and handling, easily scales off.

Graphite layers are applied by the widely used method which is based on the perception that graphite absorbs a larger quantity of heat energy on the discharge side, than the uncoated quartz. This layer can be easily prepared but it yields satisfactory results with certain additives only (mostly NaI, TlI, InI).

SUMMARY OF THE INVENTION

Our invention relates to metal halogen vapor discharge lamps with a coating of a heat reflecting layer of the zirconium oxide type, which coating can be used also in lamps containing the most critical rare earth metals. The functioning of said lamps is influenced not only by the excellent heat insulating properties of the $ZrO_2$ but also by its heat reflecting ability. As already indicated above, these excellent layers cannot be applied in a satisfactory manner.

When preparing the layer, we are confronted to the following problem:

The wall of the discharge space is made mainly of silica glass. As it is well known, the thermal expansion of the silica glass is very low. The ceramic material, e.g. $ZnO_2$, has substantially different thermal expansion properties. The ceramic material should be applied onto this silica glass of low thermal expansion, if possible, not too compacted, under the observance of the following conditions:

from the point of view of the faultless function of the ceramic layer, during mass production all parameters, among them the layer thickness, should be kept at a constant value with narrow tolerances;

the ceramic layer should bear the considerable thermal differences between the outer and inner surface; on the inner side facing the quartz tube, the temperature amounts to about 800° C., while on the outer surface the temperature is considerably lower; when switching on and off, changes in the temperature take place very quickly;

even after several thousand working hours the ceramic coating must not shrink;

the preparation of the ceramic layer requires a binding material which does not deteriorate the quartz, i.e. does not result in devitrification;

during preparation of the layer avoid any temperature exceeding the operational temperature, since such a temperature damages the discharge tube;

in lamps provided with an external bulb, the ceramic layer must not emit gases which could contaminate the gas space of the outer bulb.

There is a known process which could fulfill the above criteria, however, at the same time mass production of the known processes becomes complicated.

In the specification of the Federal Republic of Germany published application DE-OS No. 2,009,684 a process is described, wherein a ceramic layer applied by using an organic binding material is burnt. The drawback of this process lies in that in order to avoid the occurrence of hydrogen containing gases in the outer bulb, the quartz bodies has to be heated in an oxidizing atmosphere leading often to damage to the molybdenum terminals.

In the process described in U.S. Pat. No. 3,851,200, $ZrO_2$ is applied by using alkali-free glasses. The drawback of this method lies in, that large quantities (20–60%) of binding material has to be used, causing considerable deterioration of the heat insulating properties. Another drawback lies in that binding of the glass having a high softening point requires a relatively high fire-in temperature in the range between 900° and 1200° C.; as mentioned above, this high temperature is damaging to the discharge tube.

In the U.S. Pat. No. 3,842,304, a method is described in which the heat reflecting coating is formed as a double layer. The inner or first layer which coats the discharge wall consists of a black or dark grey material of high melting point and a low vapour pressure. The second layer, consists of a white material of high melting point and low vapour pressure is applied onto said first layer. In this reference the claims are relatively broad, while the examples and sub-claims indicate that the inner dark first layer is formed by a graphite layer. The graphite can indeed by applied without any difficulties onto the quartz tube, but to apply a thick $ZrO_2$ layer adhering in a reliable manner seems nearly impossible. The situation will be the same, when carbides are used for the dark layers.

BRIEF DESCRIPTION OF THE DRAWING

The drawing shows a side section in elevation of the metal halogen vapor lamp of this invention.

DETAILED DESCRIPTION

The aim of this invention is to eliminate the difficulties and problems mentioned above and to provide a metal halogen vapor lamp with good heat reflecting parameters, onto which a reflecting coating may be applied without difficulty. The coating, even when applied in a thick layer, should adhere with neither peeling off nor bubbling occuring.

A further aim of our invention has been to improve the parameters and to prolonge the useful life of the lamp by developing a heat reflecting layer, which fulfils its task during the entire life of service of the lamp without peeling off and keeps its heat reflecting properties on a constant level, avoiding change in the colour of the lamp. By using the process according to our invention the costs of production may be considerably reduced.

According to the invention the lamp is prepared in such a manner, that the quartz body known per se is coated on both ends with a layer, which contains zirconium oxide, eventually zirconium oxide stabilized with calcium as an essential constituent and magnesiumoxychloride as binding material.

The drawing shows a high pressure gas discharge lamp 12 comprising a quartz glass discharge vessel having a cylindrical section 1 of approximately 30 mm external diameter. The two ends of section 1 adjoin conical sections 2 and 3 which are closed by pinches 4 and 5 respectively. Current supply elements 6 and 7 are sealed in a vacuum-tight manner in the pinches 4 and 5 respectively. These current supply elements are connected within the discharge vessel to electrodes 8 and 9 respectively which consist of tungsten filaments secured to tungsten pins. The distance between the two electrodes 8 and 9 is approximately 100 mm. In practice the lamp is usually mounted in an evacuated or inert gas-filled outer glass envelope (not shown).

In order to prevent the presence of the area of lowest temperature on the wall of the discharge vessel surrounding the electrode 8, that is, the conical section 2 and a part of the pinch 4, an external coating or heat reflecting layer 10 is provided on the part of the discharge vessel located around and behind the electrode 8. The coating 10 is located on part of pinch 4 and extends across the conical section 2 up to several millimeters before the tip of the electrode 8. A similar coating 11 is likewise applied around the electrode 9.

The elaboration of our invention was based on the advantageous properties of the magnesium cement invented in 1867 by Sorel. We have discovered, that the $MgO$-$MgCl_2$-$H_2O$ paste, hardening to a solid mass of the hardness of marble in a short time, could be well used for solving the problems related to the preparation of the heat reflecting coating, and simultaneously a part of the Mg-content could be incorporated into the $ZrO_2$, thus stabilizing it. Even though the so-called Sorel-cement has been known for a long time, its application for producing lamps resulted not only in absolutely new, but also in unexpected and surprisingly new effects.

In accordance with our invention, the coating or heat reflecting layer 10 is prepared as follows, pulverized zirconium oxide ($ZrO_2$) is mixed with pulverized magnesia ($Mg0$) and the mixture is suspended in alcohol; before applying, an aqueous alcoholic solution of $MgCl_2$ is admixed. The resulting suspension is applied by spraying or spreading to form a homogenous heat reflecting layer 10 in the desired thickness at each end of the outside surface of the discharge tube 12 between the conical sections 2 and 3 and the pinches 4 and 5 respectively. Binding of the layer 10 takes place within 1–2 hours. After the layer 10 has been dried, it can be immediately used. When the layer 10 is applied in lamps with external bulbs no, gases which deteriorate the function of the lamp are emitted.

In accordance with our invention, the heat reflecting layer can be produced with a double coating and in a more advantageous manner, than previously used methods. An inner or first coating of cobalt aluminate or a mixture of cobalt aluminate and zirconium oxide is used, then an outer layer of zirconium oxide is used. Both layers are bound by magnesiumoxychloride to the external surface of the quartz discharge tube. No binding problems are associated with the cobalt aluminate and its heat insulating and absorbing properties are excellent.

In case of less stringent requirements regarding the heat insulation, the application of our invention enables the use of pure magnesiumoxychloride without the need to add any additive for increasing heat insulating effect, since this material alone is a relatively good heat insulator and forms a mechanically excellent resistant layer can be obtained.

In accordance with our invention, it is possible to substitute the pulverized heat insulating (heat reflecting) material partly or entirely by a fibrous material. It seems to be most efficacious to use quartz-wool cut the length of some millimeters, e.g., the product of the Company Morgan, known under the name "Kaowool," or any other equivalent inorganic fibrous material (e.g. slag wool). This approach can be advantageously used, when extremely large surfaces are to be coated with a layer of maximum thickness.

The invention will be described in detail by means of preferred embodiments, which are shown by the way of example only, without restricting the scope of the invention thereto.

EXAMPLE 1

A 250 W metal halogen vapour lamp with an outer bulb, and a rare earth metal filling is prepared so, that the ends of the quartz discharge tube, from the middle of the flattened part or pinch to the beginning of the cylindrical part at the conical sections, is sprayed in a thickness of about 0.5 mm with the following suspension prepared as described below:

In the first phase suspension "A" and solution "B" are prepared.

Suspension "A": 400 g $ZrO_2$ and 20 g $Mg0$ in approx. 400 ml alcohol are ground in a ball-mill for 4 hours.

Solution "B": 20 g $MgCl_2$ is dissolved in a mixture of 20 ml alcohol and 3 ml water.

Before spraying, the solution "B" is poured into suspension "A" and mixed. Then the resulting suspension is sprayed or spread onto the outside surface of the ends of the quartz discharge tube.

Within 2 hours the sprayed coating forms a hard compact layer containing magnesiumoxychloride on $ZrO_2$. Thereafter the quartz bodies are burnt under known electrical parameters for 10 minutes and according to known methods in lamp production, they are then mounted into the outer bulb. While the outer bulb is being evacuated, the lamp is subjected to heat treatment at 550° C. for 15 minutes.

The outer bulb of the lamp produced according to this Example 1 exhibited no traces of gas-emission on the getter after 5000 working hours. No damage could be observed at the characterizing firing voltage.

EXAMPLE 2

To the suspension prepared according to Example 1, 90 g cobalt aluminate are admixed. Thereafter the methods, as described in Example 1, is followed except, that a coating thickness of 0.4 mm is applied.

EXAMPLE 3

In the preparation of a double-layered heat reflecting coating, a 0.2 mm thick layer is first prepared by applying a suspension containing cobalt aluminate, prepared according to Example 2. Onto this first layer an 0.1 mm thick second layer, prepared according to Example 1 is applied.

EXAMPLE 4

A coating containg fibrous material is prepared for a 3500 W metal halogen vapour lamp described in Example 1 as follows.

40 g Kaowool (product "Morgan") cut to the length of 2–3 mm are added to suspension "A" prepared according to Example 1. Further procedures are performed, as described in Example 1, with the difference that the thickness of the layer applied is approx. 0.4 mm.

I claim:

1. A metal halogen vapor lamp having a discharge tube which is permeable to light and has a high melting point, wherein there are electrodes at each end of said discharge tube having power supply elements attached thereto, said discharge tube containing inside thereof a metal of high vapor pressure at operational temperatures, a noble gas and at least one metal and a halogen which forms a metal halide with said metal and a heat reflecting layer coated on said discharge tube in an area adjacent said electrodes, the improvement wherein a binding layer comprising $MgO$-$MgCl_2$-$H_2O$ is between the heat reflecting layer and the discharge tube, binding them together.

2. A metal halogen vapor lamp of claim 1 wherein the discharge tube is made of quartz glass.

3. A metal halogen vapor lamp of claim 1 wherein the heat reflecting material comprises zirconium oxide.

4. A metal halogen vapor lamp of claim 2 wherein the heat reflecting coating consists of two layers, an inner or first layer held onto the outside surface of said discharge tube and containing cobalt aluminate, and a second layer comprising zirconium oxide on the first layer.

5. A metal halogen vapor lamp of claim 1 wherein said heat reflecting layer additionally contains an inorganic fibrous material.

* * * * *